US006817546B2

(12) United States Patent
Battistini et al.

(10) Patent No.: US 6,817,546 B2
(45) Date of Patent: Nov. 16, 2004

(54) VALVE BODY FOR A FUEL INJECTOR

(75) Inventors: Lorenzo Battistini, Cesena (IT); Massimo Neretti, San Lazzaro di Savena (IT); Andrea Ricci, San Michele (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 222 days.

(21) Appl. No.: 10/205,701

(22) Filed: Jul. 26, 2002

(65) Prior Publication Data

US 2003/0038187 A1 Feb. 27, 2003

(30) Foreign Application Priority Data

Jul. 27, 2001 (IT) ..... BO2001A0482

(51) Int. Cl.[7] ..... F02M 61/10; B05B 1/30; B05B 1/00

(52) U.S. Cl. ..... 239/533.12; 239/533.14; 239/596; 239/494; 239/585.5; 239/88

(58) Field of Search ..... 239/88–92, 533.12, 239/533.2, 533.3, 533.11, 533.14, 538, 537, 585.1–585.5, 596, 451, 457, 494, 484

(56) References Cited

U.S. PATENT DOCUMENTS

| | | | | | |
|---|---|---|---|---|---|
| 4,971,254 | A | * | 11/1990 | Daly et al. | 239/489 |
| 5,192,048 | A | | 3/1993 | Wakeman | 251/129.16 |
| 5,409,169 | A | * | 4/1995 | Saikalis et al. | 239/404 |
| 6,039,272 | A | * | 3/2000 | Ren et al. | 239/597 |
| 6,179,227 | B1 | * | 1/2001 | Ren et al. | 239/497 |
| 6,182,912 | B1 | | 2/2001 | Muller et al. | 239/585.1 |
| 6,202,936 | B1 | * | 3/2001 | Frick | 239/5 |
| 6,296,199 | B1 | * | 10/2001 | Noller et al. | 239/533.12 |

* cited by examiner

*Primary Examiner*—Davis Hwu
(74) *Attorney, Agent, or Firm*—Baker & Daniels

(57) ABSTRACT

Valve body for a fuel injector; the valve body is provided with a cylindrical tubular container which has a central cylindrical cavity, a valve seat which is disposed at a lower end of the tubular container, a pin which can engage the valve seat and is accommodated in a sliding manner inside the tubular container, a lower guide for the pin, which guide is accommodated in the valve seat, and an upper guide for the pin which is contained in a support element, which is disposed at an upper end of the tubular container and defines a pair of supply apertures which open into the cavity for supply of fuel to the cavity itself.

27 Claims, 4 Drawing Sheets

VALVE BODY FOR A FUEL INJECTOR

The present invention relates to a valve body for a fuel injector.

BACKGROUND OF THE INVENTION

A known fuel injector normally comprises a valve body which is provided with a cylindrical tubular container which has a central cylindrical cavity, a valve seat which is disposed at a lower end of the tubular container, a pin which can engage the valve seat and is accommodated in a sliding manner inside the tubular container, and two, lower and upper guides for the pin which is accommodated in the tubular container.

Although they are widely used, the known valve bodies of the above-described type are produced with a design structure which is relatively complicated, and is therefore costly to produce and assemble.

SUMMARY OF THE INVENTION

The object of the present invention is to provide a valve body for a fuel injector which is free from the above-described disadvantages, and in particular is easy and economical to implement.

According to the present invention a valve body for a fuel injector is provided as indicated in claim 1.

BRIEF DESCRIPTION OF THE DRAWINGS

The present invention will now be described with reference to the attached drawings, which illustrate some non-limiting embodiments of the invention, in which.

DETAILED DESCRIPTION OF THE INVENTION

Figure 1:
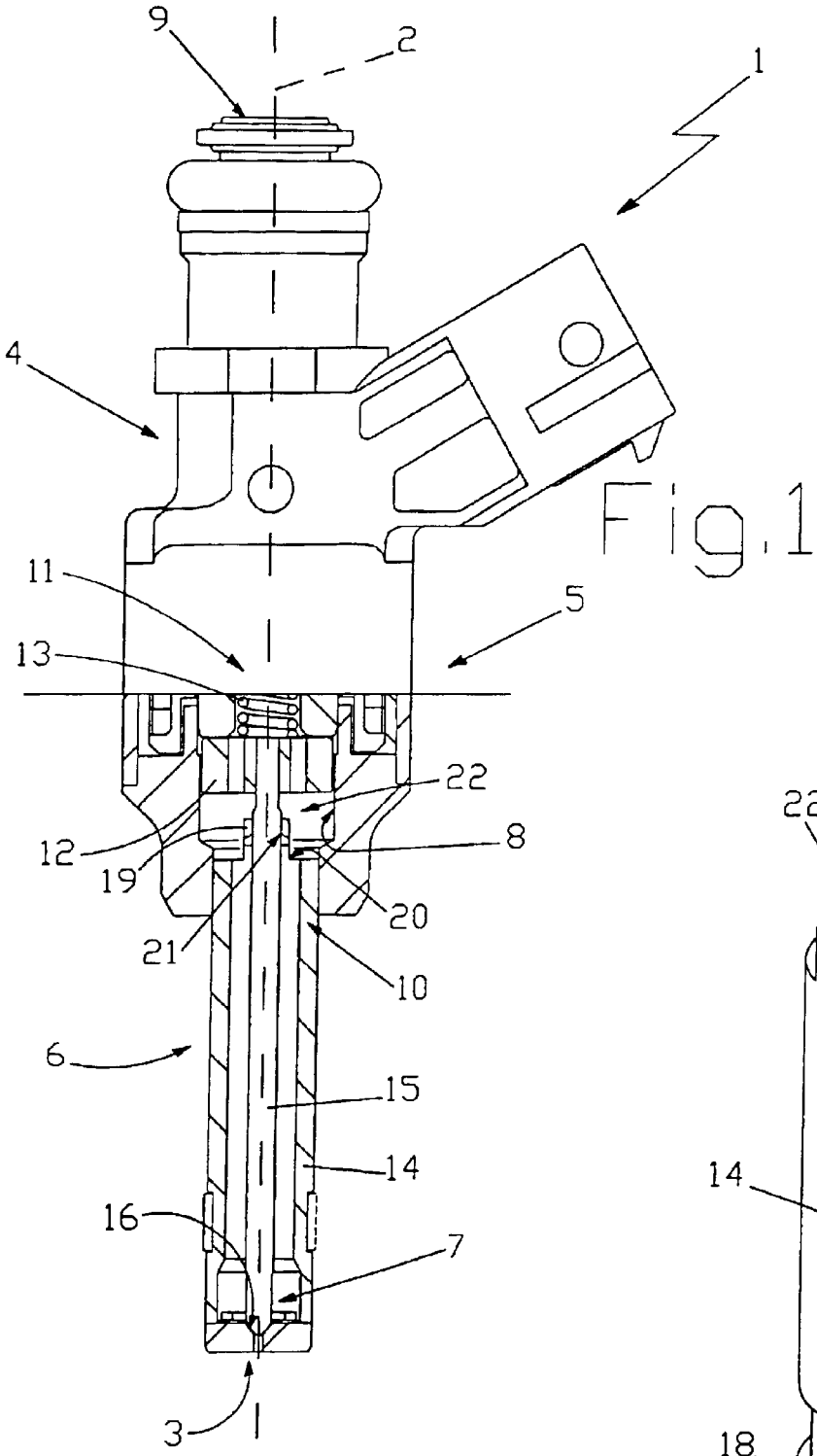
FIG. 1 is a schematic view, in lateral elevation and partially in cross-section of a fuel injector produced according to the present invention.

In FIG. 1, 1 indicates as a whole a fuel injector, which has substantially cylindrical symmetry around a longitudinal axis 2 and can be controlled in order to inject liquid fuel, typically petrol or diesel, from its own injection nozzle 3. The injector 1 comprises an upper actuator body 4 which accommodates an electromagnetic actuator 5, and a lower valve body 6, which is integral with the actuator body 4 and accommodates a valve 7 which is actuated by the electromagnetic actuator 5 in order to regulate the flow of fuel from the injection nozzle 3.

The actuator body 4 has a substantially cylindrical inner cavity 8, which receives the pressurised fuel from an upper supply aperture 9, ends in a lower aperture 10 which is engaged by the valve body 6, and accommodates the electromagnetic actuator 5.

Figure 2:
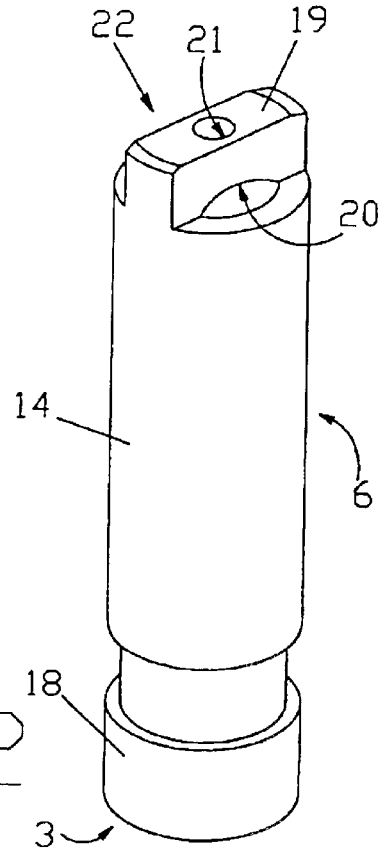
FIG. 2 is a perspective view of a valve body of the fuel injector in FIG. 1 on an enlarged scale.
Figure 3:
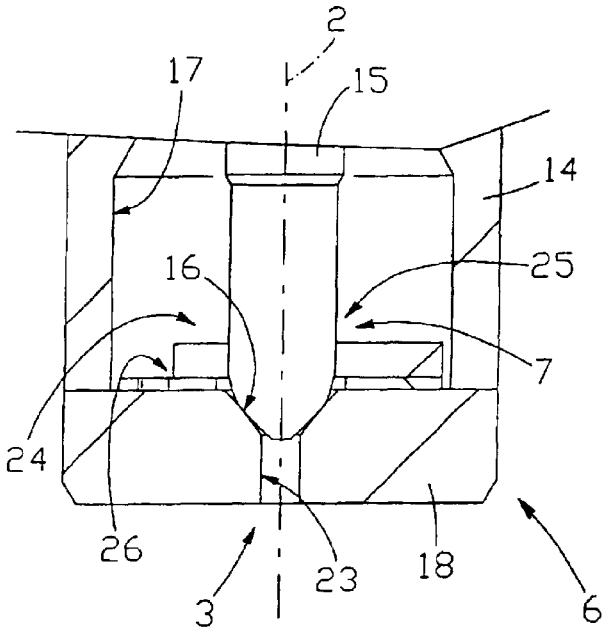
FIG. 3 is a view on an enlarged scale and in cross-section of an end portion of the valve body in FIG. 2.
Figure 7:
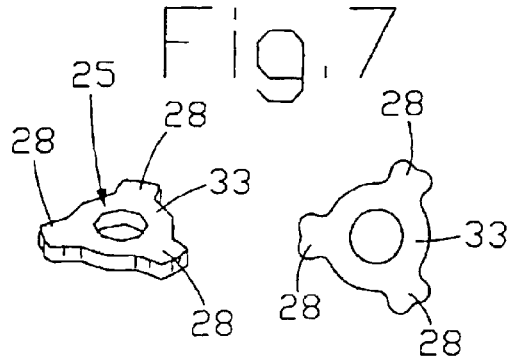
FIGS. 6 and 7 are perspective plan views of two components of the sealing element in FIG. 4.
Figure 6:
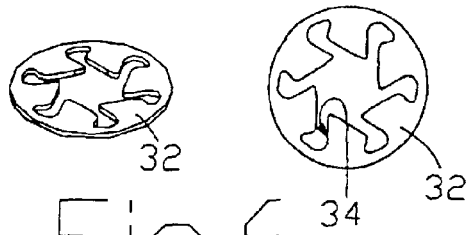
Figure 5:
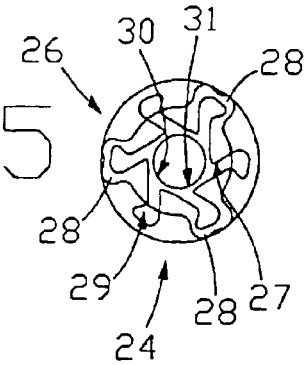
FIG. 5 is a plan view of the sealing element in FIG. 4.
Figure 4:
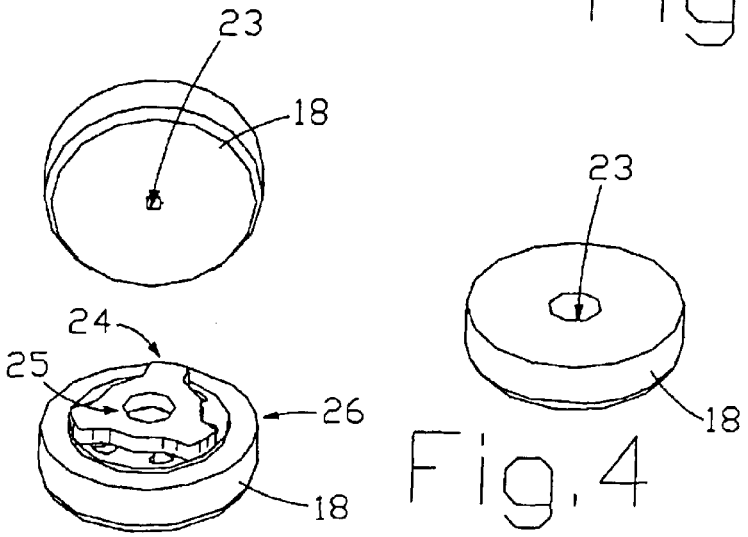
FIG. 4 are perspective views of a sealing element in FIG. 3.

The electromagnetic actuator 5 comprises a fixed electromagnet 11, which can displace an anchor 12 made of ferromagnetic material along the axis 2 from a position of closure (not illustrated) to a position of opening (illustrated in FIGS. 1 and 2) against the action of a spring 13 which tends to keep the anchor 12 in the position of closure.

The valve body 6 comprises a substantially cylindrical tubular container 14 which accommodates a shutter or pin 15, which has an upper portion which is integral with the anchor 12 and co-operates with a valve seat 16 in order to regulate the flow of fuel from the injection nozzle 3 in a known manner. In particular, the tubular container 14 has a central cylindrical cavity 17, which extends along the entire length of the tubular container 14, is closed at the base in a fluid-tight manner by a sealing element 18 in which the valve seat 16 is defined and is partially closed at the top by a support element 19 which is disposed such as to define two supply apertures 20 which are disposed symmetrically on opposite side of the axis 2 and open into the cavity 17 for the supply of fuel to the cavity 17 itself.

The support element 19 is defined by a bar, which is disposed symmetrically along a diameter of the circular upper end of the tubular container 14 and has a width which is smaller than the dimension of the cavity 17 such as to define the supply apertures 20 laterally; the support element 19 also has a through hole 21, which is disposed coaxially to the axis 2 and can accommodate the shutter 15 in a sliding manner such as to constitute an upper guide 22 for the shutter 15 itself.

According to a preferred embodiment, the support element 19 is initially in the form of a disc for closure of the upper end of the tubular container 14, the two supply apertures 20 being provided by means of subsequent removal (typically by means of milling) of respective lateral portions of this closure disc.

The above-described structure of the valve body 6 has the advantage that it can be produced simply and economically, since it makes it possible to obtain simply and directly on the tubular container 14 both the upper guide 22 for the shutter 15, and the supply apertures 20. In addition, the tubular container 14 has at the top a pointed shape, which facilitates insertion of the valve seat 6 in the actuator body 4, and securing of the seat to the body; for this purpose, the tubular container 14 is made of hard stainless steel in order to press the flash which is present in the actuator body 4 at the moment of connection between the tubular container 14 and the actuator body 4, which is made of a soft type of magnetic stainless steel.

The sealing element 18 is in the form of a disc and has an injection hole 23, which constitutes the injection nozzle 3 and in use is engaged by a pointed end portion of the shutter 15 in order to interrupt the flow of fuel which flows through the injection hole 23 itself; there is connected to the sealing element 18 a shaped body 24, which comprises a lower guide 25 for the shutter 15 and a rotary nozzle 26 which can impart rotational motion to the fuel which flows through the injection hole 23.

The shaped body 24 is substantially the form of a disc which is perforated centrally, has an outer diameter which is smaller than the inner diameter of the tubular cavity 17, comprises a series of tangential channels 27 which are provided in its own lower portion, and comprises a number of outer radial projections 28 which have the function both of positioning the shaped body 24 inside the cavity 17, and the function of being connected to the sealing element 18 by being welded.

Each tangential channel 27 extends between its own intake mouth 29 which is disposed in the vicinity of an outer periphery of the shaped body 24 and its own outlet 30 which opens into the central hole 31 in the shaped body 24; the intake mouths 29 are disposed laterally relative to the radial projections 28 such as to be independent from the radial projections 28 themselves, i.e. in other words, the projections 28 do not make any contribution towards defining the geometry of the intake mouths 29. This characteristic is particularly useful, since it makes it possible to determine the number, form and position of the projections 29 solely on the basis of the function of centering and securing of the shaped body 24, and permits simplification of the construction and fitting of the shaped body 24.

According to the embodiment illustrated in FIGS. 3–7, the shaped body 24 is formed by the joining of two superimposed discs 32 and 33, the upper disc 33 is provided with the radial projections 28 and is provided with the lower guide 25 for the shutter 15, whereas the lower disc 32 is disposed between the sealing element 18 and the upper disc 33 and is provided with through grooves 34 which define the lateral walls of the tangential channels 27. In this configuration, the sealing element 18 defines the lower wall of the tangential channels 27 and the upper disc 33 defines the upper wall of the tangential channels 27 themselves.

In the embodiment illustrated in FIGS. 3–7, the three functions of fluid-tightness, generation of the tangential motion of the fuel injected, and guiding of the shutter 15, are allocated to three different components since the sealing element provides the fluid-tightness, the lower disc 32 generates the tangential motion, and the upper disc accommodates the lower guide 25 for the shutter 15; this structure has various advantages, since it permits considerable simplicity in production both of the sealing element 18, and of the discs 32 and 33, and permits a high level of flexibility in obtaining a wide range of calibrations of the rotary nozzle 26.

Figure 8:
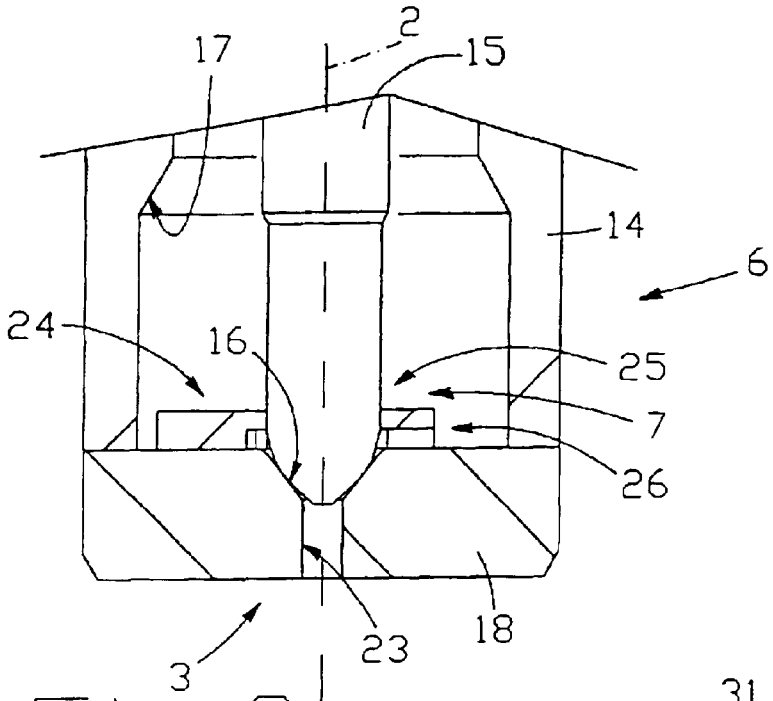
FIG. 8 is a view on an enlarged scale and in cross-section of an end portion of the valve body in FIG. 2 according to a different embodiment.
Figure 9:
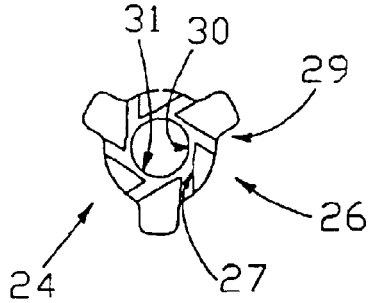
FIG. 9 are perspective views of a sealing element in FIG. 8.
Figure 9:
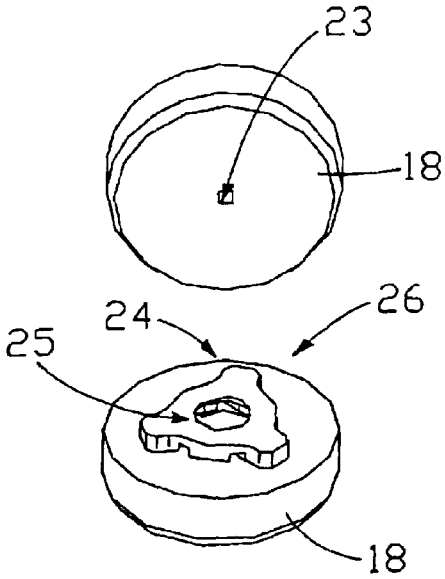
Figure 10:
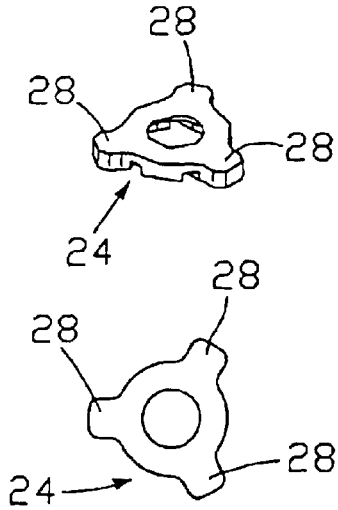
FIG. 10 are perspective plan views of a component of the sealing element in FIG. 8.

According to the embodiment illustrated in FIGS. 8–10, the shaped body 24 is a monolithic body, in which there are defined both the lateral walls, and the upper wall of the tangential channels 27, whereas the lower wall of the tangential channels 27 is defined by an upper surface of the sealing element 18; this structure makes it possible to simplify the movement and fitting of the shaped body 24 on the sealing element 18.

Figure 13:
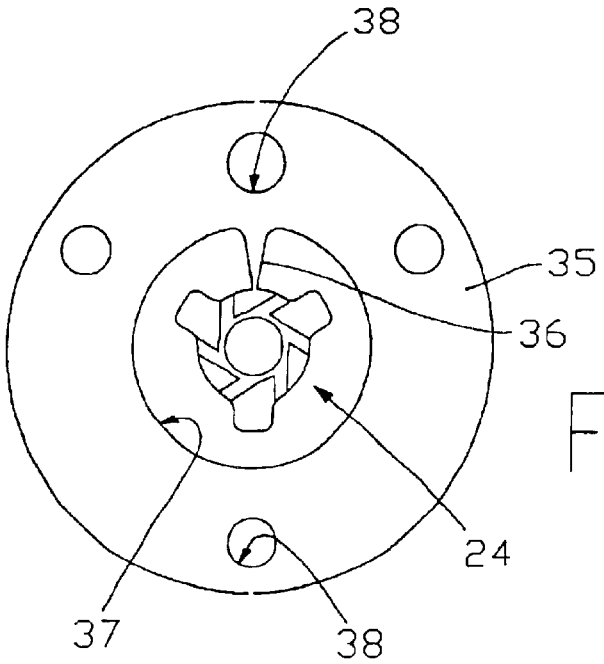
FIGS. 11, 12 and 13 are plan views of the components in FIGS. 6, 7 and 10 provided with respective service bodies.
Figure 12:
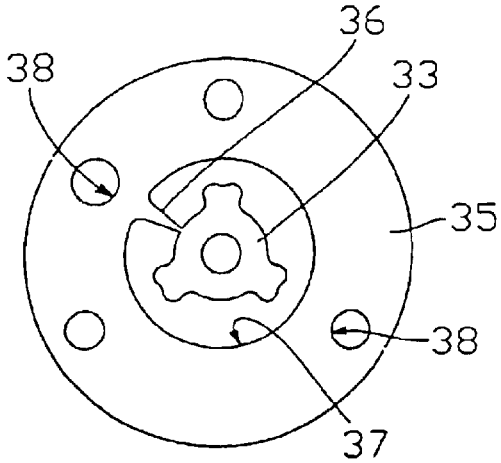
Figure 11:
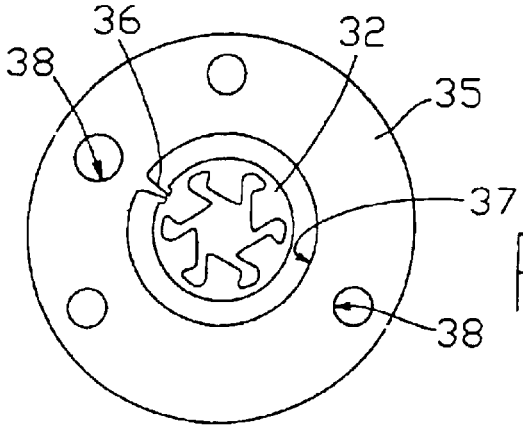

According to a preferred embodiment illustrated in FIGS. 11–13, in order to produce the valve seat 16, the monolithic shaped body 24 (FIG. 13) or the two discs 32 and 33 which constitute the shaped body 24 (FIGS. 11 and 12) are produced such that they are rendered integral with an appropriate service body 35 by means of a corresponding connection element 36. In order to fit the shaped body 24 onto the sealing element 18, the corresponding service body 35 is disposed in a position which is determined in order to position the shaped body 24 in the required position relative to the sealing element 18; subsequently the position of the shaped body 24 is stabilised by connecting the shaped body 24 itself (typically by means of welding) to the sealing element 18, and the connection element 36 is interrupted by means of breakage in order to eliminate the service body 35.

Preferably, each service body 35 is in the shape of a disc and has a central hole 37, inside which there is disposed the shaped body 24 or the two discs 32 and 33 which constitute the shaped body 24; by means of this configuration the connection element 36 is disposed radially.

In order to obtain correct positioning relative to the sealing element 18 of the shaped body 24 or of the two discs 32 and 33 which constitute the shaped body 24, the appropriate service body 35 has at least one positioning hole 38, which is connected in use to a corresponding stop device (which is known and not illustrated). Preferably, each service body 35 has four positioning holes 38 in order to guarantee also correct orientation in relation to the sealing element 18 of the shaped body 24 or of the two discs 32 and 33 which constitute the shaped body 24.

Use of the service bodies 35 makes it possible to simplify considerably the movement, positioning and orientation of the shaped body 24 or of the two discs 32 and 33 which constitute the shaped body 24; in fact both the shaped body 24 and the two discs 32 and 33 which constitute the shaped body 24 are normally particularly complex to move and fit owing to their small dimensions (for example, the lower disc 32 typically has a diameter of 4 mm and a thickness of 0.2 mm).

In order to construct the discs 32 and 33 which constitute the shaped body 24, or in order to construct the monolithic shaped body 24 (with or without the appropriate service bodies 35) use is preferably made of photoengraving, which makes it possible to obtain a high level of accuracy in production, together with low production costs.

What is claimed is:

1. Valve body (6) for a fuel injector (1); the valve body (6) comprising a cylindrical tubular container which has a central cylindrical cavity (17), a valve seat (16) which is disposed at a lower end of the tubular container (14), a pin (15) which can engage the valve seat (16) and is accommodated in a sliding manner inside the tubular container (14), a pair of lower and upper guides (25, 22) which can support the pin (15) in a sliding manner and are accommodated by the tubular container (14), and a support element (19), which is disposed at an upper end of the tubular container (14), accommodates the said upper guide (22), and defines at least one supply aperture (20) which opens into the cavity (17) for supply of fuel to the cavity (17) itself; said support element (19) defining two said supply apertures (20), which open into the said central cavity (17) and are disposed symmetrically on opposite sides of a central axis (2) of the said tubular container (14); and said support element (19) being defined by a bar, which is disposed symmetrically along a diameter of the circular upper end of the said tubular container (14) and has a width which is smaller than the dimension of the said cavity (17) such as to define laterally the said supply apertures (20).

2. Valve body (6) according to claim 1, wherein the said support element (19) comprises a through hole (21) which is disposed coaxially to the tubular container (14); the said through hole (21) being able to accommodate the said pin (15) in a sliding manner and defining the said upper guide (22).

3. Valve body (6) according to claim 1, wherein the said support element (19) is initially in the form of a disc for closure of the upper end of the said tubular container (14); the said two supply apertures (20) being provided by removal of respective lateral portions of the said closure disc.

4. Valve body (6) according to claim 1, wherein the said valve seat (16) is defined by a sealing element (18), which can define a lower, fluid-tight closure of the said tubular container (14) and has an injection hole (23) which is engaged by the said pin (15).

5. Valve body (6) according to claim 4, wherein the said valve seat (16) comprises a rotary nozzle (26), which can impart rotational motion to the fuel which flows from the said injection hole (23).

6. Valve body (6) according to claim 5, wherein the said valve seat (16) comprises a shaped body (24), which is connected to the said sealing element (18) and defines both the said rotary nozzle (26), and the said lower guide (25).

7. Valve body (6) according to claim 6, wherein the said shaped body (24) is substantially in the form of a disc which is perforated centrally, which has an outer diameter which is smaller than the inner diameter of the said cavity (17), comprises a series of tangential channels (27) which are provided in its own lower portion, and comprises a number of outer radial projections (28) which have the function of positioning inside the cavity (17), and the function of being connected to the sealing element (18).

8. Valve body (6) according to claim 7, wherein each said tangential channel (27) extends between its own intake mouth (29) which is disposed in the vicinity of an outer periphery of the shaped body (24) and its own outlet (30) which opens into the said central hole (31) of the shaped body (24); the intake mouths (29) being disposed laterally relative to the said radial projections (28) such as to be independent from the radial projections (28) themselves.

9. Valve body (6) according to claim 7, wherein the said shaped body (24) is a monolithic body.

10. Valve body (96) according to claim 7, wherein the said shaped body (24) is formed by the joining of two superimposed upper and lower discs (32,33); the upper disc (33) being provided with the said radial projections (28) and being provided with the said lower guide; the lower disk (32) being disposed between the said sealing element (18) and the upper disc (33) and being provided with through grooves (34) which define the lateral walls of the said tangential channels (27); the said sealing element (18) defining a lower wall of the said tangential channels (27) and the upper disc (33) defining an upper wall of the said tangential channels (27).

11. Valve body (6) according to claim 4, wherein the said lower guide (25) is accommodated in the said valve seat (16).

12. Valve body (6) for a fuel injector (1); the valve body (6) comprising a cylindrical tubular container (14) which has a tubular central cavity (17), a valve seat (16) which is disposed at a lower end of the tubular container (14), a pin (15) which can engage the valve seat (16) and is accommodated in a sliding manner inside the tubular container (14), and at least one lower guide (25) which is accommodated by the tubular container (14) and can support the pin (15) in a sliding manner; the valve seat (16) being defined by a sealing element (18) which can define a lower fluid-tight closure of the said tubular container (14) and has an injection hole (23) which is engaged by the said pin (15); the said valve seat (16) comprising a shaped body (24), which is connected to the said sealing element (18) and defines a rotary nozzle (26) and the said lower guide (25); said shaped body (24) being substantially in the form of a disc which is perforated centrally, which has an outer diameter which is smaller than the inner diameter of the said cavity (17), comprises a series of tangential channels (27) provided in its own lower portion, and comprises a number of outer radial projections (28) which have the function of positioning inside the cavity (17) and the function of being connected to the said sealing element (18).

13. Valve body (6) according to claim 12, wherein each said tangential channel (27) extends between its own intake mouth (29) which is disposed in the vicinity of an outer periphery of the shaped body (24) and its own outlet (30) which opens into the said central hole (31) in the shaped body (24); the intake openings (29) being disposed laterally relative to the said radial projections (28) such as to be independent from the radial projections (28) themselves.

14. Valve body (6) according to claim 12, wherein the said shaped body (24) is a monolithic body.

15. Valve body (6) according to claim 12, wherein the said shaped body (24) is formed by the joining of two superimposed upper and lower discs (32, 33); the upper disc (33) being provided with the said radial projections (28) and being provided with the said lower guide (25); the lower disc (32) being disposed between the said sealing element (18) and the upper disc (33) and being provided with through grooves (34) which define the lateral walls of the said tangential channels (27); the said sealing element (18) defining a lower wall of the said tangential channels (27) and the upper disc (33) defining an upper wall of the tangential channels (27).

16. Method for production of a valve seat (16) for a fuel injector (1); the valve seat (16) comprising a sealing element (18) which has an injection hole (23) engaged by a mobile pin (15), and a shaped body (24), which is connected to the sealing element (18) and defines a rotary nozzle (26); the method comprising the following steps:

producing said shaped body (24) integrally with a service body (35) by means of at least one connection element (36), disposing the service body (35) in a pre-determined position in order to position the shaped body (24) in the required position in relation to the sealing element (18), stabilizing the position of the shaped body (24) by connecting the shaped body (24) itself to the sealing element (18), and interrupting the connection element (36) in order to eliminate the service body (35).

17. Method according to claim 16, wherein the said shaped body (24) also defines a lower guide (25) for the said pin (15).

18. Method according to claim 16, wherein the said service body (35) is in the shape of a disc and has a central hole (37); the said shaped body (24) being disposed inside the said central hole (37) and the said connection element (36) being disposed radially.

19. Method according to claim 16, wherein the said service body (35) has at least one positioning seat (38); the method consisting of connecting the said positioning seat (38) to a stop device in order to place the service body (35) in the said pre-determined position.

20. Method according to claim 19, wherein the said service body (35) has three positioning seats (38) which are different from one another; the method consisting of connecting each said positioning seat (38) to a respective stop device in order to place the service body (35) in the said pre-determined position.

21. Method according to claim 19, wherein each said positioning seat (38) is defined by a through hole.

22. Method according to claim 16, wherein the said shaped body (24) consists of two superimposed bodies (32, 33), each of which is provided with a respective said service body (35).

23. Method according to claim 16, wherein the said shaped body (24) or the superimposed bodies (32, 33) which constitute the shaped body (24) itself, are produced by means of photoengraving.

24. Valve body (6) for a fuel injector (1); the valve body (6) comprising a cylindrical tubular container which has a central cylindrical cavity (17), a valve seat (16) which is disposed at a lower end of the tubular container (14), a pin (15) which can engage the valve seat (16) and is accommodated in a sliding manner inside the tubular container (14), a pair of lower and upper guides (25, 22) which can support the pin (15) in a sliding manner and are accommodated by the tubular container (14), and a support element (19), which is disposed at an upper end of the tubular container (14), accommodates the said upper guide (22), and defines at least one supply aperture (20) which opens into the cavity (17) for supply of fuel to the cavity (17) itself; said valve seat (16) being defined by a sealing element (18), which can define a lower, fluid-tight closure of the said tubular container (14) and has an injection hole (23) which is engaged by the said pin (15); said valve seat (16) comprising a rotary nozzle (26), which can impart rotational motion to the fuel which flows from the said injection hole (23), and a shaped body (24), which is connected to the said sealing element (18) and defines both the said rotary nozzle (26), and the said lower guide (25); said shaped body (24) being substantially in the form of a disc which is perforated centrally, which has an outer diameter which is smaller than the inner diameter of the said cavity (17), comprises a series of tangential channels (27) which are provided in its own lower portion, and comprises a number of outer radial projections (28) which have the function of positioning inside the cavity (17), and the function of being connected to the sealing element (18).

25. Valve body (6) according to claim 24, wherein each said tangential channel (27) extends between its own intake mouth (29) which is disposed in the vicinity of an outer periphery of the shaped body (24) and its own outlet (30) which opens into the said central hole (31) of the shaped body (24); the intake mouths (29) being disposed laterally relative to the said radial projections (28) such as to be independent from the radial projections (28) themselves.

26. Valve body (6) according to claim 24, wherein the said shaped body (24) is a monolithic body.

27. Valve body (96) according to claim 24, wherein the said shaped body (24) is formed by the joining of two superimposed upper and lower discs (32,33); the upper disc (33) being provided with the said radial projections (28) and being provided with the said lower guide; the lower disk (32) being disposed between the said sealing element (18) and the upper disc (33) and being provided with through grooves (34) which define the lateral walls of the said tangential channels (27); the said sealing element (18) defining a lower wall of the said tangential channels (27) and the upper disc (33) defining an upper wall of the said tangential channels (27).

* * * * *